US010874925B2

(12) United States Patent
Putman

(10) Patent No.: US 10,874,925 B2
(45) Date of Patent: Dec. 29, 2020

(54) GOLF SWING TRAINING KIT

(71) Applicant: Putman House, LLC, Harrison, MI (US)

(72) Inventor: Kasey Putman, Harrison, MI (US)

( * ) Notice: Subject to any disclaimer, the term of this patent is extended or adjusted under 35 U.S.C. 154(b) by 0 days.

(21) Appl. No.: 16/776,101

(22) Filed: Jan. 29, 2020

(65) Prior Publication Data

US 2020/0238147 A1 Jul. 30, 2020

Related U.S. Application Data

(60) Provisional application No. 62/798,144, filed on Jan. 29, 2019.

(51) Int. Cl.
*A63B 69/36* (2006.01)
*A63B 69/00* (2006.01)
*A63B 71/00* (2006.01)

(52) U.S. Cl.
CPC ..... *A63B 69/0079* (2013.01); *A63B 69/3623* (2013.01); *A63B 71/0036* (2013.01); *A63B 2209/00* (2013.01)

(58) Field of Classification Search
CPC ..... A63B 69/0079; A63B 71/0036; A63B 69/3623; A63B 2209/00
USPC ..... 473/138, 139, 142, 147
See application file for complete search history.

(56) References Cited

U.S. PATENT DOCUMENTS 1,448,505 A * 3/1923 Powers ..... A63B 57/00 473/131
1,528,909 A * 3/1925 Bullard ..... A63B 69/0079 473/146
1,579,294 A * 4/1926 Fisk ..... A63B 69/0079 473/147
2,768,775 A * 10/1956 Houser ..... A63B 57/20 221/185
3,051,491 A * 8/1962 Cabot ..... A63B 43/007 473/147
3,521,887 A * 7/1970 Butkus ..... A63B 69/0084 473/147
3,804,409 A * 4/1974 Schachner ..... A63B 69/0079 473/423
4,071,250 A * 1/1978 Vroome ..... A63B 69/0079 473/143
4,660,835 A * 4/1987 Locurto ..... A63B 69/0079 473/147
4,927,154 A * 5/1990 Boyer ..... A63B 69/0079 273/DIG. 21
4,989,877 A * 2/1991 Bias ..... A63B 69/0079 273/DIG. 21
5,054,786 A * 10/1991 Solomon ..... A63B 69/0079 473/147
6,343,996 B1 * 2/2002 Gasseling ..... A63B 69/0079 473/142

* cited by examiner

*Primary Examiner* — Nini F Legesse

(74) *Attorney, Agent, or Firm* — Honigman LLP; Matthew H. Szalach; Jonathan P. O'Brien

(57) ABSTRACT

A golf swing training kit includes a training system having a ball and an anchor connected together by a tether and one or more tees. The golf swing training kit also includes a rack including a ball receptacle configured to removably receive the ball of the training system, an anchor socket configured to removably receive the anchor of the training system, one or more tee sockets configured to removably receive the one or more tees, and a spool configured to removably receive the tether of the training system.

20 Claims, 1 Drawing Sheet

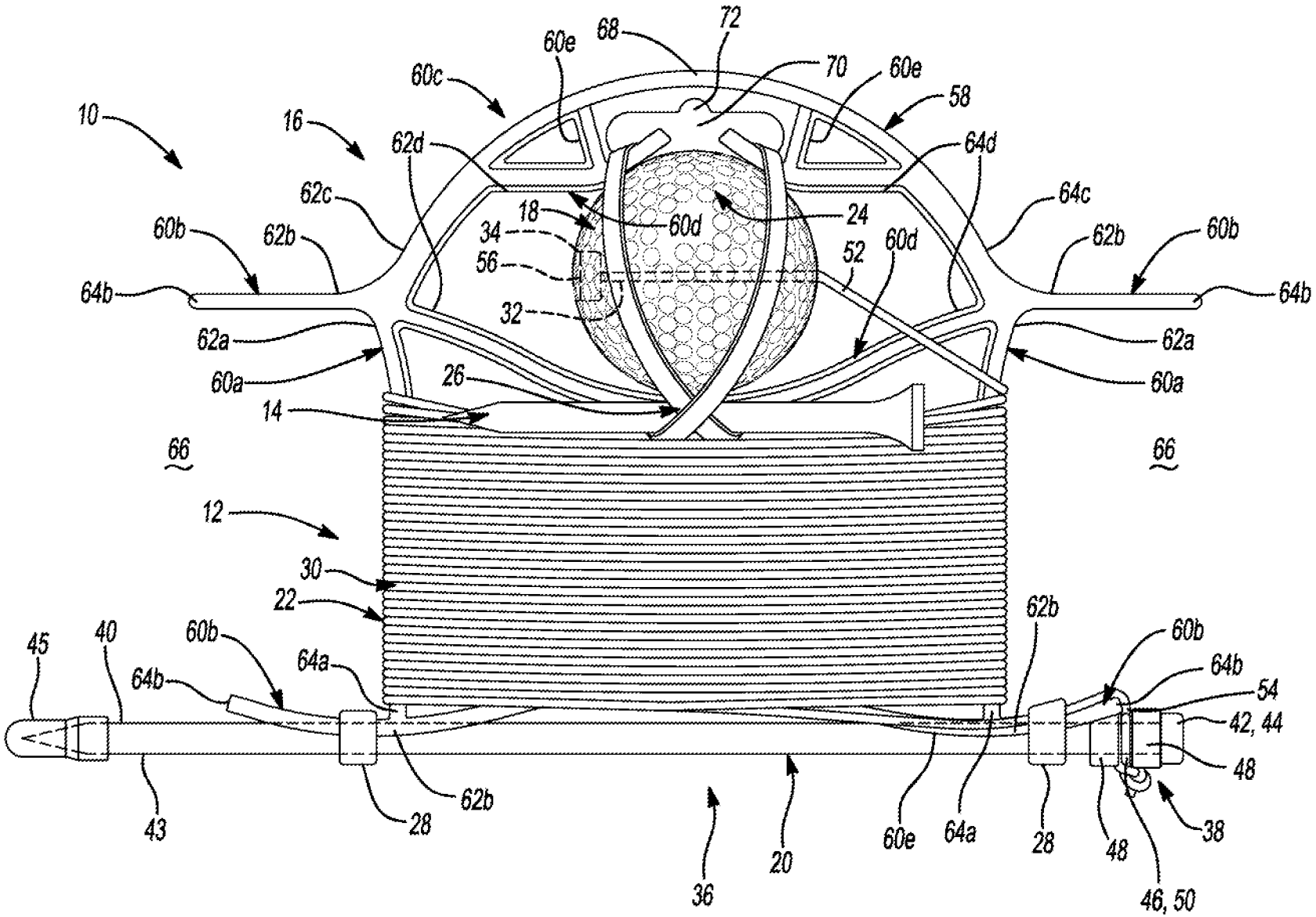
64b
60b
62a
60a
66
62b
64c
64d
58
60e
70
72
68
60e
60c
16
10
64b
60b
62b
62c
62d
18
34
56
32
24
52
60d
60d
26
14
12
30
22
62a
60a
66
62b
28
64a
60e
20
36
62b
28
64a
60b
64b
40
43
45
54
42, 44
48
38
46, 50
48
60b
64b

GOLF SWING TRAINING KIT

CROSS REFERENCE TO RELATED APPLICATION

This non-provisional U.S. Patent Application claims priority under 35 U.S.C. § 119(e) to U.S. Provisional Patent Application Ser. No. 62/798,144, filed Jan. 29, 2019, the disclosure of which is hereby incorporated by reference in its entirety.

TECHNICAL FIELD

This disclosure relates to golf equipment, and more particularly, to a golf swing training kit.

BACKGROUND

There exists a need in the art for providing an efficient way to repeatedly practice hitting a golf ball.

SUMMARY

One aspect of the disclosure provides a golf swing training kit. The golf swing training kit includes a training system having a ball and an anchor connected together by a tether. The golf swing training kit also includes a rack having a ball receptacle configured to removably receive the ball of the training system, an anchor socket configured to removably receive the anchor of the training system, one or more tee sockets configured to removably receive one or more tees, and a spool configured to windingly and removably receive the tether of the training system.

Implementations of the disclosure may include one or more of the following optional features. In some implementations, the rack includes a first receptacle rib and a second receptacle rib spaced apart from the first receptacle rib to define the ball receptacle. Here, the first receptacle rib may include a bending feature formed between a first end of the first receptacle rib and a second end of the first receptacle rib.

In some examples, the rack includes a handle. Here, the ball receptacle may be disposed between the spool and the handle. In some configurations, the spool includes an opposing pair of spool ribs spaced apart from each other and each including a first end and a second end. Here, the rack may include a first pair of guide ribs projecting in a first direction from one of the spool ribs and a second pair of guide ribs projecting in a second direction from the other one of the spool ribs. Optionally, the first direction may be opposite from the second direction. The rack may be formed of a molded polymeric material. The anchor may be a shank including a cylindrical shaft.

Another aspect of the disclosure provides a golf swing training system. The system includes a ball and an anchor including a shank and a hub. The system also includes a tether having a first end attached to the ball and a second end attached to the hub of the anchor.

This aspect may include one or more of the following optional features. In some implementations, the shank of the anchor includes a cylindrical shaft. The hub may be disposed at a first end of the shaft. The hub may include a pair of dampers and an axle interposed between the dampers. The axle may be formed of a first material having a lower coefficient of friction than the dampers, and the dampers may be formed of a second material having a hardness that is less than the axle and the shaft. The second end of the string is received around the axle and between the dampers.

In some examples, the first end of the tether includes a knot received within the ball. Here, the knot may be received within a counterbore of the ball. The tether may be formed of a braided nylon string. The tether may have a length ranging from 70 feet to 80 feet.

The details of one or more implementations of the disclosure are set forth in the accompanying drawings and the description below. Other aspects, features, and advantages will be apparent from the description and drawings, and from the claims.

DESCRIPTION OF DRAWINGS

The drawings described herein are for illustrative purposes only of selected configurations and are not intended to limit the scope of the present disclosure.

FIG. 1 shows a golf swing practice kit according to the principles of the present disclosure.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth, such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Referring to FIG. 1, a golf swing training kit 10 according to the principles of the present disclosure is shown. The kit 10 includes a golf swing training system 12, at least one tee 14, and a rack 16 configured to receive the training system 12 and the at least one tee 14. The training system 12 includes a ball 18, an anchor 20, and a tether 22 connecting the ball 18 to the anchor 20. The rack 16 includes a receptacle 24 configured to receive and secure the ball 18, one or more tee sockets 26 each configured to receive and secure one of the tees 14, an anchor socket 28 configured to receive and secure the anchor 20, and a spool 30 for winding the tether 22.

Referring again to FIG. 1, the ball 18 of the training system 12 has an outside diameter ranging from 1.5 inches to 1.75 inches, and more specifically, 1.68 inches. In some examples, the ball 18 has a weight ranging from 1 ounce to 3 ounces, and more specifically, 1.62 ounces. In some examples, the ball 18 may be formed of a solid rubber core having a thermoplastic resin cover. Accordingly, in some examples, the ball 18 may be a market standard golf ball 18. However, other types of balls 18 may be used to provide different training characteristics.

As discussed in greater detail below, the ball 18 may include an aperture 32 formed through a central axis of the ball 18. The aperture 32 is configured to receive the tether 22 therethrough, and may include a counterbore 34 or countersink formed at one end. Particularly, the counterbore 34 is formed in the outer surface of the ball 18 and has a diameter and depth suitable to receive and secure an end of the tether 22, as discussed below.

The anchor 20 is configured to fixture the training system 12 to a ground surface. In the illustrated example, the anchor 20 is configured to fixture the training system 12 to a soft surface, such as dirt or turf. As shown in FIG. 1, the anchor 20 is an elongate stake including a cylindrical shank 36 and a hub 38. In the illustrated example, the shank 36 is formed of a metal, such as steel, and is coated with a zinc coating to maximize corrosion resistance. In some examples, the anchor 20 may be unitarily formed, whereby the shank 36 and the hub 38 are formed as a single piece. However, in other examples the hub 38 may be separately formed of a different material than the shank 36, and secured to the shank 36.

The shank 36 is cylindrical and includes a first end 40 and a second end 42 formed at an opposite end of the shank 36 from the first end 40. A distance from the first end 40 to the second end 42 defines a length of the shank 36. The shank 36 has a length ranging from 8 inches to 12 inches, and more particularly, 10 inches. The shank 36 includes a shaft 43 extending from the first end 40 and having a diameter ranging from ¼ of an inch to ½ of an inch, and more particularly, ⅜ of an inch. In some examples, the first end 40 of the shank 36 may be tapered to a point to ease insertion of the shank 36 into the ground surface. The second end 42 of the shank 36 may include a head 44 having a greater diameter than the diameter of the shaft 43. The anchor 20 may be provided with a rubber cap 45 for covering the first end 40.

The hub 38 is disposed on the shaft 43 at the second end 42 of the shank 36. Accordingly, the hub 38 may be adjacent to and/or abut the head 44. In the illustrated example, the hub 38 is a polymeric bushing having a cylindrical axle 46 disposed between a pair of cylindrical dampers 48. As shown, the axle 46 and the dampers 48 are configured to receive the shaft 43 of the shank 36 and are arranged in order of—damper 48, axle 46, damper 48—whereby the axle 46 is interposed between the dampers 48. The dampers 48 have a greater outside diameter than the axle 46. Accordingly, a cylindrical channel 50 is formed around the axle 46 and between opposing faces of the dampers 48.

The axle 46 and the dampers 48 may be formed of different materials. For example, the axle 46—or at least an outer circumferential surface of the axle 46—may be formed of a rigid material having a relatively low coefficient of friction. In some examples, the shaft 43 of the shank 36 may act as the axle 46. In some examples, the axle 46 may be formed of a polymeric material different from the material of the shank 36. Where the axle 46 is formed as a separate component from the shank 36, the axle 46 may be rotatable about the shank 36.

The dampers 48 are formed of a resilient material, such as rubber. Accordingly, the dampers 48 are configured to dissipate impact forces associated with the use of the training system 12. Particularly, when the ball 18 is struck by a user and travels away from the anchor 20, the dampers 48 will dissipate the energy transferred from the tether 22 to the anchor 20 when the tether 22 snares the ball 18.

Referring again to FIG. 1, the tether 22 includes a first end 52 attached to the ball 18, and a second end 54 attached to the axle 46 of the hub 38 between the dampers 48. The first end 52 extends through the aperture 32 of the ball 18 and is secured within the counterbore 34. The first end 52 may include a knot 56 disposed within the counterbore 34. As shown, the knot 56 is flush or recessed from the outer surface of the ball 18 to maintain an uninterrupted contact surface of the ball 18. A diameter (not shown) of the knot 56 is greater than a diameter (not shown) of the aperture 32, thereby preventing the first end 52 of the tether 22 from passing through the aperture 32. In some examples, the knot 56 is a slip knot 56 that is configured to increase in size when the first end 52 of the tether 22 is under tension to maintain integrity between the tether 22 and the ball 18

In the illustrated example, the tether 22 is formed of a braided nylon string having a 165 pound (734 Newton) test. A length of the tether 22—measured as the distance from the first end 52 to the second end 54 when the tether 22 is in an extended state—ranges from 70 feet to 80 feet, and more particularly 75 feet. The combination of the use of the braided nylon string and the length of 75 feet has been found to provide the training system 12 with self-reloading properties, whereby the elasticity of the tether 22 and the length of the tether 22 cooperate to return the ball 18 to the user after the ball 18 is hit.

As discussed above, the rack 16 includes the ball receptacle 24, the tee sockets 26, the anchor socket 28, and a spool 30 for winding the tether 22 during storage of the training system 12. The rack 16 may also define a handle 58 so that the rack 16 can be easily grasped by a user when transporting the training system 12.

Referring to FIG. 1, the rack 16 is formed of a plurality of ribs 60*a*-60*e* each extending from a first end 62*a*-62*e* to a second end 64*a*-64*e*. The ribs 60*a*-60*e* each extend along a longitudinal axis or path (i.e. from first end 62*a*-62*e* to second end 64*a*-64*e*) in the same plane, whereby all of the ribs 60*a*-60*e* are parallel to each other. In the illustrated example, the ribs 60*a*-60*e* are substantially coplanar, such that the rack 16 is provided with a substantially planar profile (i.e., constant thickness or depth). The rack 16 is formed of a resilient polymeric material. In some examples, the rack 16 is unitarily formed from a molded polymeric material.

A first pair of ribs 60*a* are referred to as spool ribs 60*a*. The spool ribs 60*a* oppose each other and are substantially parallel and spaced apart from each other by a distance. Each of the spool ribs 60*a* extends from a first end 62*a* to a second end 64*a* and includes an intermediate portion formed between the first end 62*a* and the second end 64*a*. In use, the tether 22 is wound around the intermediate portions of the spool ribs 60*a* (i.e., the tether 22 extends from one spool rib 60*a* to the other spool rib 60*a*, and back).

The rack 16 further includes a plurality of guide ribs 60*b* projecting outwardly from the ends 62*a*, 64*a* of the respective spool ribs 60*a*. A longitudinal axis (i.e., axis extending from first end 62*b* to second end 64*b*) of each of the guide ribs 60*b* is transverse to a longitudinal axis of the spool ribs 60*a* (i.e., axis extending from first end 62*a* to 64*a*), and the guide ribs 60*b* are substantially parallel to each other. As shown, the guide ribs 60*b* include a first pair of guide ribs 60*b* projecting outwardly from opposite ends 62*a*, 64*a* of a first one of the spool ribs 60*a*, and a second pair of guide ribs 60*b* projecting outwardly from opposite ends 62*a*, 64*a* of a second one of the spool ribs 60*a*. The guide ribs 60*b* of each pair are separated from each other to define a space 66 between the respective guide ribs 60*b* for receiving and retaining the tether 22 when the tether 22 is wound around the spool ribs 60*a*. The first pair of guide ribs 60*b* project in a first direction and the second pair of guide ribs 60*b* project in a second direction, opposite the first direction. Accordingly, the spool 30 comprises two spaces 66 on opposite sides of the rack 16 through which the tether 22 can be wound.

The handle 58 of the rack 16 is formed by a handle rib 60*c* extending along an arcuate path from a first end 62*c* at the first end 62*a* of the first one of the spool ribs 60*a* to a second end 64*c* at the first end 62*a* of the second one of the spool ribs 60*a*. As shown, the handle rib 60*c* extends away from the spool 30 of the rack 16, whereby the arcuate path along which the handle rib 60*c* extends is concave with respect to the spool 30. The handle rib 60*c* includes an apex 68 between the first end 62*c* and the second end 64*c*, and may include an opening or notch 70 formed at the apex 68 for hanging the rack 16.

The rack 16 further includes a plurality of receptacle ribs 60*d*, which are spaced apart from each other and cooperate to define the receptacle 24 of the rack 16. A first one of the receptacle ribs 60*d* extends continuously along an arcuate path from a first end 62*d* at the first end 62*a* of the first one of the spool ribs 60*a* to a second end 64*d* at the first end 62*a* of the second one of the spool ribs 60*a*. As shown, the first one of the receptacle ribs 60*d* extends into the spool 30 of the rack 16 (i.e., between the spool ribs 60*a*), whereby the arcuate path along which the handle rib 60*c* extends is convex with respect to the spool 30.

A second one of the receptacle ribs 60*d* is spaced apart from the first one of the receptacle ribs 60*d* and extends between opposite portions of the handle rib 60*c*. Particularly, a first end 62*d* of the second receptacle rib 60*d* is attached to the handle rib 60*c* between the first end 62*c* of the handle rib 60*c* and the apex 68, and a second end 64*d* of the second receptacle rib 60*d* is attached to the handle rib 60*c* between the second end 64*c* of the handle rib 60*c* and the apex 68. An intermediate portion of the second receptacle rib 60*d* may include a bending feature 72. In some example, the bending feature 72 is a gap that separates the second receptacle rib 60*d* into independent tabs. In other examples, the bending feature 72 may be a portion of the second receptacle rib 60*d* having a reduced thickness, which acts as a living hinge configured to allow the second receptacle rib 60*d* to flex in a direction away from the first receptacle rib 60*d*. Accordingly, the bending feature 72 allows second receptacle rib 60*d* to resiliently flex to receive and secure the ball 18 between the receptacle ribs 60*d*.

As provided above, the receptacle ribs 60*d* cooperate to define the receptacle 24 disposed between the spool 30 and the handle 58. As shown in FIG. 1, when the ball 18 is disposed within the receptacle 24, the second receptacle rib 60*d* is biased away from the first receptacle rib 60*d* by the outer surface of the ball 18. Because an outside diameter of the ball 18 is greater than the distance between the receptacle ribs 60*d* when the receptacle ribs 60*d* are in a resting state, the resilience of the receptacle ribs 60*d* will cause the receptacle ribs 60*d* to be biased against the outer surface of the ball 18, thereby frictionally securing the ball 18 within the receptacle 24.

The rack 16 may further include one or more tee sockets 26 configured to receive a shaft of one or more of the golf tees 14. In the illustrated example, the tee sockets 26 are associated with the first one of the receptacle ribs 60*d*. The rack 16 may include a pair of tee sockets 26 formed on opposite sides of the rack 16 for removably securing two tees to the rack 16. The rack 16 may also include one or more anchor sockets 28 configured to receive the shaft 43 of the anchor 20. In the illustrated example, the anchor sockets 28 are formed on the guide ribs 60*b* at the second ends 64*a* of the spool ribs 60*a*. The anchor sockets 28 are formed on an opposite side of the guide ribs 60*b* from the spool 30.

The rack 16 may include one or more reinforcement ribs 60*e* extending between adjacent ones of the ribs 60*a*-60*d*. As shown, a first one of the reinforcement ribs 60*e* extends between the second ends 64*a* of the spool ribs 60*a*. Additional reinforcement ribs 60*e* are disposed between the handle rib 60*c* and the second receptacle ribs 60*d*.

In use, the training system 12 may be removed from the rack 16 by disengaging the ball 18 from the ball receptacle 24 and disengaging the anchor 20 from the anchor sockets 28. The tether 22 is then unwound from the spool 30 to release the training system 12 from the rack 16.

With the training system 12 removed from the rack 16, the anchor 20 is inserted into the ground surface, whereby the hub 38 of the anchor 20 remains exposed above the ground surface such that the second end 54 of the tether 22 can rotate freely about the axle 16 of the anchor 20. The user then places the ball 18 adjacent to the anchor 20, and extends the intermediate portion of the tether 22 in the direction that the ball 18 will be hit. In some examples, the ball 18 may be placed on one of the tees 14. When the ball 18 is hit by the user, the ball 18 will travel in the hit direction until the tether 22 is fully extended, at which point the energy of the ball 18 will be transferred to the tether 22, causing the tether 22 to stretch and then retract, thereby drawing the ball back towards the user 22. As discussed above, the combination of the elastic tether having the described length has been found to provide suitable results for returning the ball 18 to the user. Furthermore, when the ball 18 is hit to the right or the left, the tether 22 will cause the ball 18 to be returned to the right or the left of the user, respectively, thereby indicating the direction that the ball 18 was hit.

To return the training system 12 to the rack 16, one of the ball 18 or the anchor 20 is secured within its respective retainer 24, 28 on the rack 16, and the tether 22 is wound around the spool 30. Once the tether 22 is fully wound, the other of the ball 18 or the anchor 20 is secured within its respective retainer 24, 28 to secure the training system 12 in place on the rack 16. The training kit 10 can then be transported using the handle 58, and can be stored on a hanger via the notch 70 formed in the handle.

A number of implementations have been described. Nevertheless, it will be understood that various modifications may be made without departing from the spirit and scope of the disclosure. Accordingly, other implementations are within the scope of the following claims.

What is claimed is:

1. A golf swing training kit comprising:

a training system having a ball and an anchor connected together by a tether; and a rack including a first receptacle rib and a second receptacle rib spaced apart from the first receptacle rib to define a ball receptacle configured to removably receive the ball of the training system, an anchor socket configured to removably receive the anchor of the training system, one or more tee sockets configured to removably receive one or more tees, and a spool configured to removably receive the tether of the training system.

2. The kit of claim 1, wherein the first receptacle rib includes a bending feature formed between a first end of the first receptacle rib and a second end of the first receptacle rib.

3. The kit of claim 1, wherein the rack includes a handle.

4. The kit of claim 3, wherein the ball receptacle is disposed between the spool and the handle.

5. The kit of claim 1, wherein the spool includes an opposing pair of spool ribs spaced apart from each other and each including a first end and a second end.

6. The kit of claim 5, wherein the rack includes a first pair of guide ribs projecting in a first direction from one of the spool ribs and a second pair of guide ribs projecting in a second direction from the other one of the spool ribs.

7. The kit of claim 6, wherein the first direction is opposite from the second direction.

8. The kit of claim 1, wherein the rack is formed of a molded polymeric material.

9. The kit of claim 1, wherein the anchor is a shank including a cylindrical shaft.

10. A golf swing training system comprising:

a ball;

an anchor including (a) a shank having a cylindrical shaft and (b) a hub disposed at a first end of the shaft and including a pair of dampers and an axle interposed between the dampers; and a tether having a first end attached to the ball and a second end attached to the hub of the anchor, the tether including at least one of (i) a length ranging from 70 feet to 80 feet, or (ii) a 165 pound test.

11. The system of claim 10, wherein the tether has a length of 75 feet.

12. The system of claim 11, wherein the axle is formed of a first material having a lower coefficient of friction than the dampers, and the dampers are formed of a second material having a hardness that is less than the axle.

13. The system of claim 12, wherein the second end of the tether is received around the axle and between the dampers.

14. The system of claim 11, wherein the first end of the tether includes a knot received within the ball.

15. The system of claim 14, wherein the knot is received within a counterbore of the ball.

16. The system of claim 11, wherein the tether is formed of a braided nylon string.

17. A golf swing training kit comprising:

a training system having a ball and an anchor connected together by a tether; and a rack including a ball receptacle configured to removably receive the ball of the training system, an anchor socket configured to removably receive the anchor of the training system, one or more tee sockets configured to removably receive one or more tees, and a spool configured to removably receive the tether of the training system, the spool including an opposing pair of spool ribs spaced apart from each other and each including a first end and a second end.

18. The kit of claim 17, wherein the rack includes a first pair of guide ribs projecting in a first direction from one of the spool ribs and a second pair of guide ribs projecting in a second direction from the other one of the spool ribs.

19. The kit of claim 18, wherein the first direction is opposite from the second direction.

20. The kit of claim 17, wherein the rack includes a handle.

* * * * *